US005404792A

United States Patent [19]

Watanabe et al.

[11] Patent Number: 5,404,792

[45] Date of Patent: Apr. 11, 1995

[54] PISTON FOR INTERNAL COMBUSTION ENGINE

[75] Inventors: Hiroaki Watanabe; Kazuhiko Shirane; Hideo Yoshimura, all of Atsugi, Japan

[73] Assignee: Unisia Jecs Corporation, Atsugi, Japan

[21] Appl. No.: 166,025

[22] Filed: Dec. 14, 1993

[30] Foreign Application Priority Data

Dec. 14, 1992 [JP] Japan ..... 4-332617

[51] Int. Cl.[6] ..... F01B 31/00

[52] U.S. Cl. ..... 92/126; 92/212; 92/222; 92/233; 92/237; 123/193.6

[58] Field of Search ..... 92/126, 177, 178, 212, 92/222, 233, 237; 123/193.6

[56] References Cited

U.S. PATENT DOCUMENTS

| | | | |
|---|---|---|---|
| 4,677,900 | 7/1987 | Philby | 92/212 |
| 4,715,267 | 12/1987 | Richmond | 92/237 |
| 4,752,995 | 6/1988 | Collyear et al. | 92/237 |
| 5,107,807 | 4/1992 | Arai et al. | 123/193.6 |
| 5,193,435 | 3/1993 | Parker | 123/193.6 |
| 5,245,413 | 9/1993 | Kato | 92/126 |

FOREIGN PATENT DOCUMENTS

| | | | |
|---|---|---|---|
| 4021761 | 1/1992 | Germany | 123/193.6 |
| 3-179154 | 8/1991 | Japan . | |

*Primary Examiner*—Thomas E. Denion
*Attorney, Agent, or Firm*—Foley & Lardner

[57] ABSTRACT

A piston for an internal combustion engine comprises at least a pair of ribs arranged between an inner surface portion of a skirt and side portions of pin bosses. The ribs are symmetrical with respect to a thrust center line of the piston and have in a longitudinal direction thereof a center line which is positioned to be lower than an axis of a piston pin.

6 Claims, 4 Drawing Sheets

PISTON FOR INTERNAL COMBUSTION ENGINE

BACKGROUND OF THE INVENTION

The present invention relates to a piston for an internal combustion engine.

As is generally known, due to the action of inertia force, thrust or side force resulting from combustion pressure upon expansion stroke, and moment about a piston pin, a piston for an internal combustion engine for use, e.g., in a motor vehicle is inclined during vertical reciprocating motion of one cycle, and has thrust side and counter thrust side portions of a skirt pressed on an inner surface of a cylinder.

By way of example, referring to FIG. 7, in the vicinity of the upper dead center of expansion stroke, combustion pressure makes a piston 1 produce clockwise moment M and thrust force TF on a piston pin 3 through a con'rod 2. As a result, the piston 1 is inclined so that an upper end of a counter thrust side skirt **6*b* or crown 4 comes in contact C with a counter thrust side inner surface 5*a* of a cylinder 5, whereas a lower portion of a thrust side skirt 6*a* comes in contact with a thrust side inner surface 5*b* of the cylinder 5. Subsequently, as the piston 1 goes down, gas pressure and con'rod angle are increased to augment thrust. As a result, the piston 1 is pressed on the thrust side inner surface 5*b* of the cylinder 5, and the crown 4 is moved from the thrust side TS to the counter thrust side CTS. The piston 1 separates from the cylinder 5 on the counter thrust side, and has a contact center position on the thrust side which moves from the lower portion of the thrust side skirt 6*a* to an upper portion thereof. At that moment, the thrust side skirt 6*a* undergoes maximum thrust during one cycle, so that the entirety of a skirt 6 is deformed along the cylinder inner surface 5*b*, and has increased contact area with the cylinder inner surface 5*b*, resulting in great friction of the skirt 6**.

In view of such circumstances of the art, JP-A 179154 proposes a piston having partly thick portions arranged on the reverse side of the skirt in the thrust and counter thrust directions. A step-like rigidity change is produced between each thick portion and a thin portion arranged adjacent thereto in the circumferential direction. Thus, when undergoing great side force from the cylinder inner surface, the corresponding thick portion is pressed inside without any deformation, so that the adjacent thin portion is deformed contrariwise to expand outside and come in contact with the cylinder inner surface, decreasing a contact area, resulting in reduced friction of the skirt.

With the conventional piston disclosed in JP-A 179154, however, the partly thick portions are arranged on the reverse side of the lower portion of the skirt, so that when great clockwise moment is produced in the vicinity of the upper dead center of expansion stroke as described above, the lower portion of the skirt undergoes great deformation due to a structure that the thrust side skirt has a thin portion between the thick portion and a pin boss, resulting in increased incline amount of the piston. Therefore, immediately after the upper dead center, the counter thrust side crown may crash violently against the cylinder inner surface to produce hammering.

Further, in a low-speed and low-load state after engine start, when going down after the upper dead center, the piston has a thrust side contact center position which moves from the lower portion of the skirt to the upper portion thereof. At that moment, due to smooth movement of the contact center position, cold slap can be restricted. However, since the partly thick portions are arranged on the reverse side of the lower portion of the skirt, the piston starts to contact the cylinder inner surface from a lower end of the thrust side skirt. The contact center position moves quickly to the thick portion of the lower portion of the skirt, and stays temporarily therein since thrust is supported by the thick portion. As soon as a load of thrust cannot be supported by the thick portion due to increased thrust, the contact center position moves quickly from the lower portion of the skirt to the center of the piston pin. Thus, cold slap may be produced.

Furthermore, due to increased incline amount of the piston, the piston crown should have an outer diameter determined at a relatively small value. This results in enlarged land clearance between an outer periphery of the piston crown and the cylinder inner surface. Thus, a crevice volume is increased in the vicinity of a top land, increasing a production of unburnt hydro-carbon (HC), resulting in lowering of exhaust emission performance.

It is, therefore, an object of the present invention to provide a piston for an internal combustion engine which enables a restraint of occurrence of hammering and cold slap and a reduction in frictional resistance.

SUMMARY OF THE INVENTION

According to the present invention, there is provided a piston for an internal combustion engine, the piston having a thrust center line extending from a thrust side and a counter thrust side and including a crown and a piston pin which has an axis which is normal to the thrust center line, the piston comprising:

a skirt connected to the crown, said skirt having first inner surface portions and second inner surface portions, said first inner surface portions being formed with a pair of pin bosses for supporting the piston pin;

two pairs of aprons disposed between said second inner surface portions of said skirt and said pair of pin bosses, respectively; and at least a pair of ribs arranged between one of said second inner surface portions and one of said two pairs of aprons, said at least a pair of ribs being symmetrical with respect to said thrust center line of the piston, said at least a pair of ribs having in a longitudinal direction of the piston a center line which is more distant than the axis of the piston pin with respect to the crown.

DETAILED DESCRIPTION OF THE INVENTION

Figure 1:
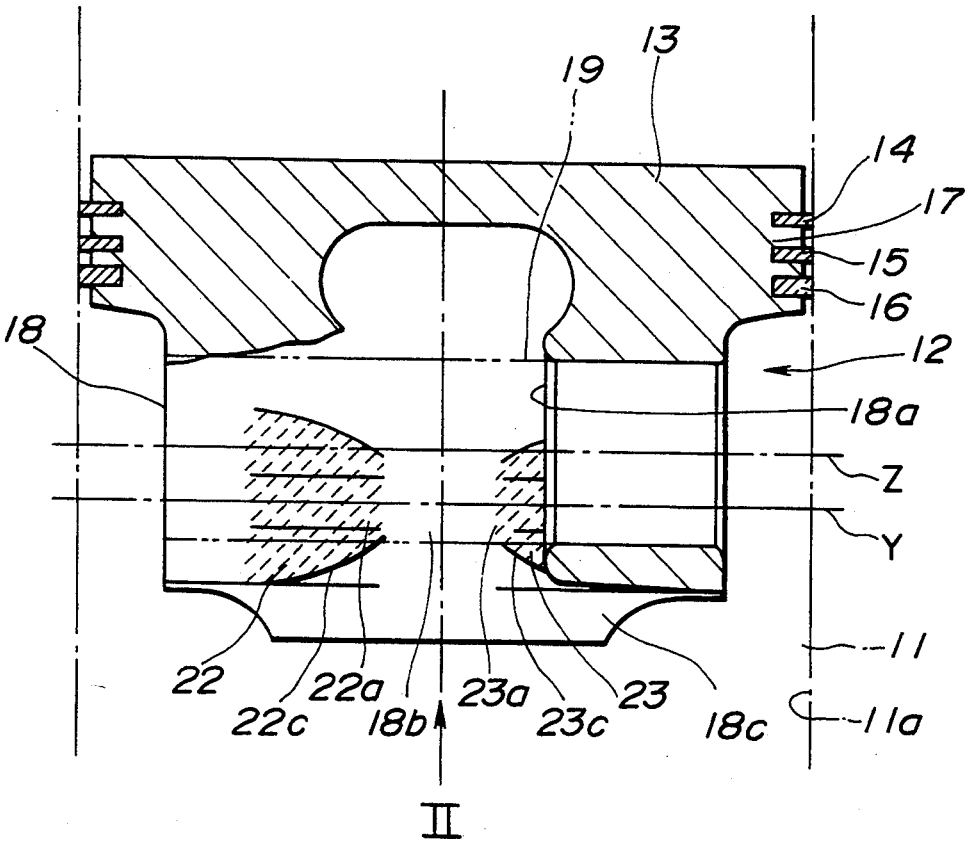
FIG. 1 is a longitudinal section showing a preferred embodiment of a piston for an internal combustion engine according to the present invention.

Referring to the drawings, particularly to FIG. 1, there is shown a piston for an internal combustion engine embodying the present invention. A piston 12 which reciprocates in a cylinder 11 of a cylinder block is made of aluminum alloy, and has a cross section formed substantially in a circle. The piston 12 includes below a crown 13 which receives combustion gas a ring land 17 formed with three piston ring grooves 14, 15, 16, and referring to FIG. 2, it also includes a thin skirt 18 integrally formed with the ring land 17 in the lower portion thereof. Pin bosses 20, 21 for supporting both ends of a piston pin 19 are formed in two 180° separated positions on an inner surface 18*a* of the skirt 18 so as to protrude inward.

Figure 2:
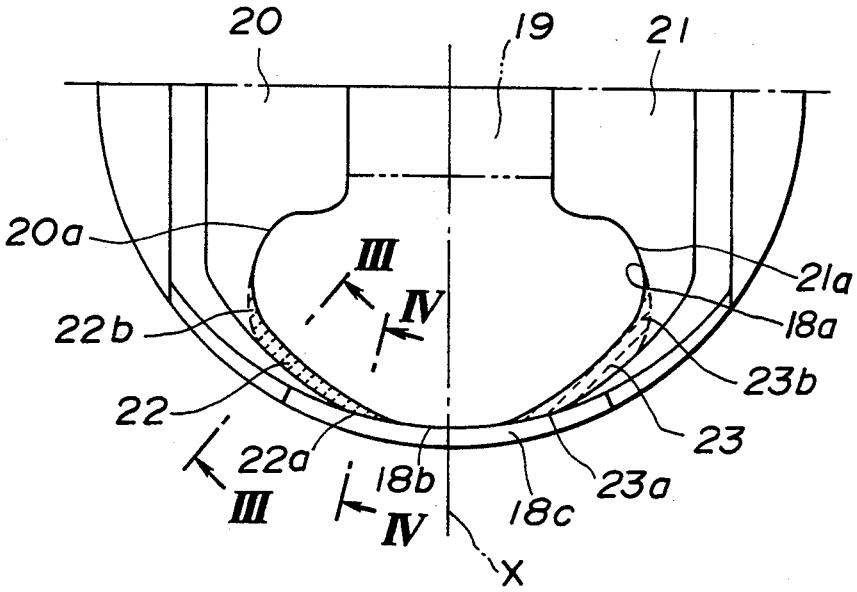
FIG. 2 is a schematic drawing as viewed from an arrow II in FIG. 1.

The skirt 18 has a cross section formed in an ellipse of a predetermined oval amount as will be described later, and includes two thin lower ends 18*c*, 18*c* on the thrust side and the counter thrust side which meet the piston pin 19 at right angles and extend downward. As best seen in FIG. 2, a pair of thick portions or ribs 22, 23 are formed along the circumferential direction and between both side portions 20*a*, 21*a* which are aprons of the pin bosses 20, 21 of the inner surface 18*a* of the skirt 18, respectively.

Specifically, as shown in FIGS. 1 and 2, the thick portions 22, 23 are formed symmetrically with respect to an axial center line X of the thrust side and the counter thrust side, respectively, each thick portion having a vertical width determined to be slightly smaller than an outer diameter of each pin boss 20, 21, and a circumferetial or longitudinal center line Y positioned to be slightly lower than a pin hole center line Z of the pin bosses 20, 21 which is an axis of the piston pin 19.

Figure 3:
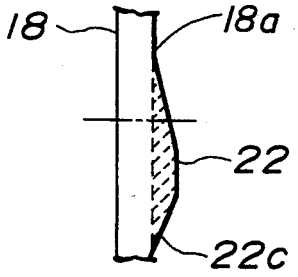
FIG. 3 is a sectional view taken along a line III—III in FIG. 2.
Figure 4:
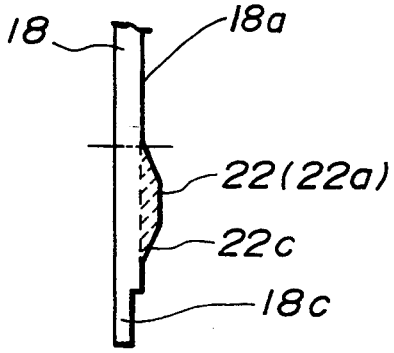
FIG. 4 is a view similar to FIG. 3, taken along a line IV—IV in FIG. 2.

Referring to FIGS. 2 to 4, the thick portions 22, 23 are formed so that the longitudinal thickness is reduced gradually from both side portions 20*a*, 21*a* of the pin bosses 20, 21 to the thin portions 18*b*, 18*b* in the vicinity of the axial center line X, whereas the vertical thickness is maximum in a portion on the longitudinal center line Y, and reduced gradually therefrom to upper and lower outer edges. Additionally, facing pointed ends 22*a*, 23*a* having a circular periphery are arranged in an angular position of approximately 10°–30° from the axial center line X in the circumferential direction, and connected continuously to the thin portions 18*b*, 18*b* of the axial center line X and in the vicinity thereof, respectively. Also, opposite base ends 22*b*, 23*b* are connected continuously to both side portions 20*a*, 21*a* of the pin bosses 20, 21.

Moreover, referring also to FIG. 1, due to a structure of the thick portions 22, 23, lower edges 22*c*, 23*c* of the thick portions 22, 23 are separated gradually from a lower edge of the skirt 18 from the base ends 22*b*, 23*b* to the pointed ends 22*a*, 23*a*. In other words, the longitudinal length of the thin portions 18*b*, 18*b* in the lower end of the skirt 18 is increased gradually from the base ends 22*b*, 23*b* of the thick portions 22, 23 to the pointed ends 22*a*, 23*a* thereof.

Figure 5:
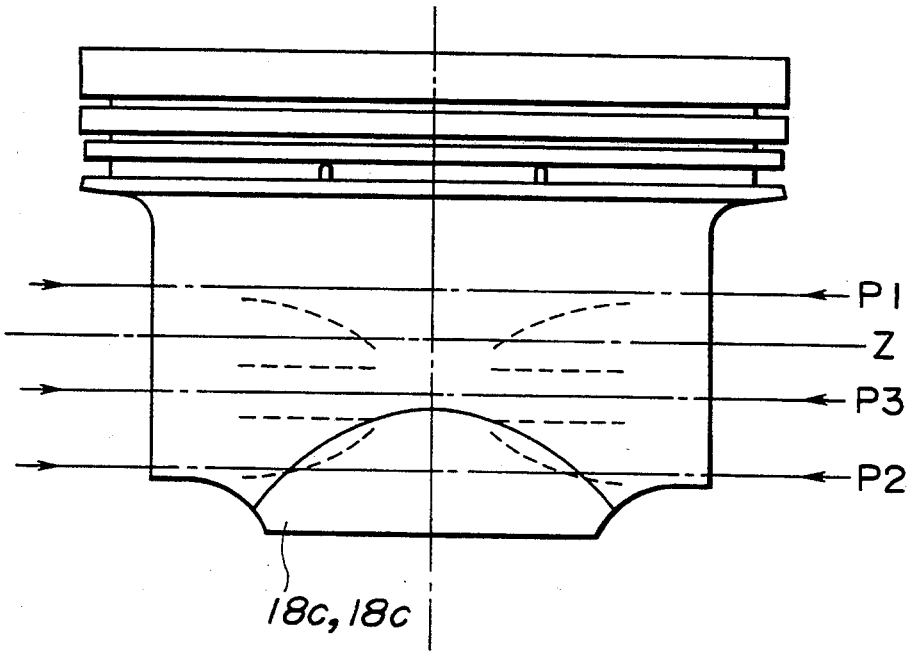
FIG. 5 is a front view showing the piston.
Figure 6:
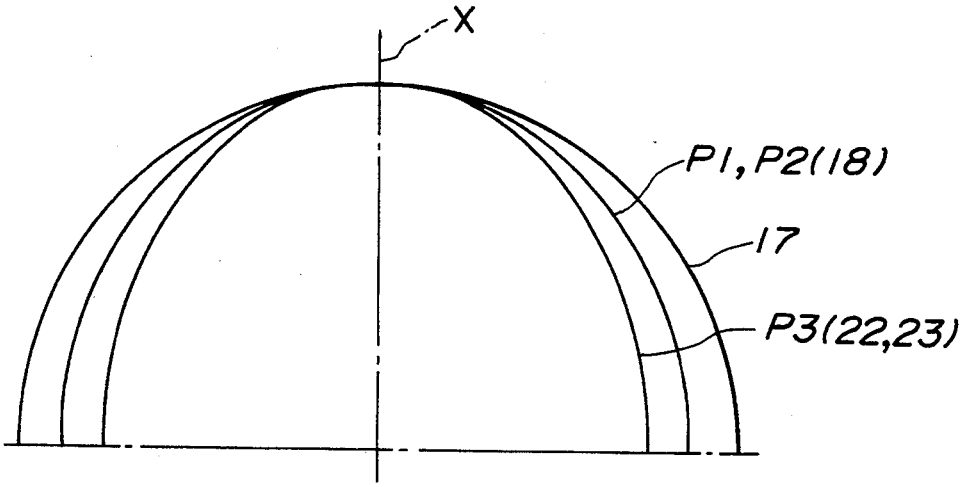
FIG. 6 is a diagrammatic drawing showing an oval amount of the piston.
Figure 7:
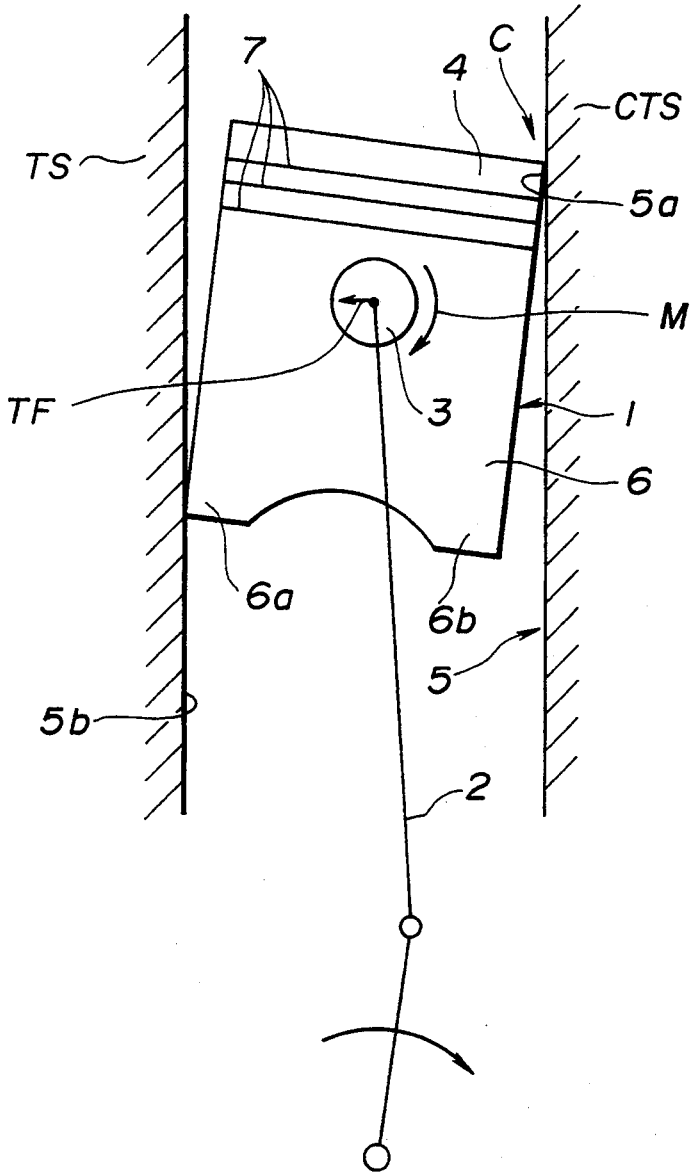
FIG.7 (PRIOR ART)
FIG. 7 is a view similar to FIG. 5, showing a conventional piston operating in a cylinder.

Moreover, referring to FIGS. 5 and 6, the skirt 18 has a cross section formed so that the contour in P1 and P2 positions or nominal contour is not a circle, but an ellipse that the sides of the axial center line X expand with a predetermined oval amount. Therefore, in a P3 position in which the thick portions 22, 23 are formed, the ellipticity is further increased.

Next, operation of this embodiment will be described. The skirt 18 has a low rigidity in the thin portions 18*b*, 18*b* on the axial center line X on the thrust side and the counter thrust side and in the vicinity thereof. On the other hand, due to formation of the thick portions 22, 23 from the thin portions 18*b*, 18*b* to the side portions 20*a*, 21*a* of the pin bosses 20, 21, the skirt 18 has a gradually increased rigidity from the axial center line X to the sides of the pin bosses 20, 21 in the circumferential direction, and from the lower ends 18*c*, 18*c* to the longitudinal center line Y of the thick portions 22, 23.

Therefore, when great clockwise moment is produced in the vicinity of the upper dead center of expansion stroke, the thin portion 18*b* in the vicinity of the axial center of the thrust side lower end 18*c* of the skirt 18 is relatively easily deformed inward, and the thick portions 22, 23 in the circumferential direction serve immediately to support this load, ensuring a restrained deformation of the skirt 18, resulting in a restraint of great tilting of the piston 12. Thus, the crown 13 on the counter thrust side fails to crash violently against the inner surface 11*a* of the cylinder 11, obtaining restrained occurrence of hammering.

Further, since the skirt 18 includes the thin portions 18*b*, 18*b* in the vicinity of the axial center line X having a thickness from the lower ends 18*c*, 18*c* to the upper ends which is generally reduced without any great change, the piston 12 starts to contact the inner surface 11*a* of the cylinder 11 from the thrust side lower end 18*c*, and the contact center position is moved upward smoothly and at a relatively quick timing after the upper dead center so as to reach a position in the vicinity of maximum thickness spots of the thick portions 22, 23 on the longitudinal center line Y. This smooth upward movement of the contact center position enables a restraint of cold slap.

Still further, due to a possible reduction in the incline amount of the piston 12, the outer diameter of the crown 13 can be determined at a value as large as possible in a range without producing hammering or cold slap. Therefore, the crevice volume in the vicinity of the top land can be reduced, resulting in a decreased production of unburnt hydro-carbon (HC).

Furthermore, due to cold slap restrained by smooth upward movement of the contact center position based on a particular structure of the thick portions 22, 23, an offset amount of the piston pin 19 can be reduced. Thus, thrust reaction or transverse reaction is decreased, obtaining a further reduction in press contact force with respect to the inner surface 11*a* of the cylinder 11, resulting in a further prevention of occurrence of wear, etc.

Further, due to a synergism of greater ellipticity (P3) of the thick portions 22, 23 than the reference ellipticity (P1, P2) of the skirt 18 and small thermal expansion push load of the thin portions 18*b*, 18*b*, frictional resistance is reduced between the skirt 18 and the inner surface 11*a* of the cylinder 11, resulting in improved fuel consumption.

Having described the present invention in connection with the preferred embodiment, it is to be noted that the present invention is not limited thereto, and various changes and modifications are possible without departing from the spirit of the present invention.

What is claimed is:

1. A piston for an internal combustion engine, the piston having a thrust center line extending from a thrust side and a counter thrust side and including a crown and a piston pin, said piston pin having an axis which is normal to the thrust center line, the piston comprising:

a skirt connected to the crown, said skirt having first inner surface portions and second inner surface portions, said first inner surface portions being formed with a pair of pin bosses for supporting the piston pin;

two pairs of aprons disposed between said second inner surface portions of said skirt and said pair of pin bosses, respectively; and at least one pair of ribs arranged between one of said second inner surface portions and one of said two pairs of aprons, said at least one pair of ribs being integrally formed with said one of said second inner surface portions and being formed wholly internal to an inner surface of said skirt, said at least one pair of ribs being symmetrical with respect to said thrust center line of the piston, said at least one pair of ribs having a center line which is more distant to the crown than the axis of the piston pin as measured in a longitudinal direction of the piston.

2. A piston as claimed in claim 1, wherein said at least one pair of ribs are arranged on the thrust side of the piston.

3. A piston as claimed in claim 2, wherein each of said at least one pair of ribs has a thickness in a vertical direction of the piston, which has a maximum on said center line of said at least one pair of ribs, and a gradually reduced value to outer edge portions.

4. A piston as claimed in claim 3, wherein each of said at least one pair of ribs has a thickness in a circumferential direction of the piston, which has a gradually reduced value from an apron side portion to a second inner surface side portion.

5. A piston as claimed in claim 4, wherein each of said at least one pair of ribs has a lower edge which is separated gradually from a lower edge of said skirt from said apron side portion to said second inner surface portion.

6. A piston as claimed in claim 1, wherein said skirt has in a portion thereof formed with said at least one pair of ribs an ellipticity greater than a reference ellipticity.

* * * * *